United States Patent [19]

Spence

[11] 4,261,400

[45] Apr. 14, 1981

[54] HYDRAULICALLY POWERED ATTACHMENT FOR A TRACTOR

[76] Inventor: David M. Spence, Afton Manor, Freshwater, Isle of Wight, England

[21] Appl. No.: 48,340

[22] Filed: Jun. 14, 1979

[51] Int. Cl.[3] ..... B27L 7/00

[52] U.S. Cl. ..... 144/193 A; 144/193 R; 173/29

[58] Field of Search ..... 173/27, 28, 29; 144/193 R, 193 A

[56] References Cited

U.S. PATENT DOCUMENTS

| | | | |
|---|---|---|---|
| 3,073,571 | 1/1963 | Wunsch | 173/27 |
| 3,780,779 | 12/1973 | Guy | 144/193 A |
| 3,834,436 | 9/1974 | Burkett | 144/2 N |
| 4,050,526 | 9/1977 | Deike | 173/27 |
| 4,073,325 | 2/1978 | Krom, Jr. | 144/193 A |
| 4,111,246 | 9/1978 | LaPointe | 144/193 A |

*Primary Examiner*—W. Donald Bray
*Attorney, Agent, or Firm*—Lawrence Rosen

[57] ABSTRACT

A hydraulically powered attachment for a tractor, which attachment can be used alternatively for pressing stakes into the grounds or splitting logs or stakes and comprising a rigid elongate mast, means whereby the mast can be mounted at or adjacent a first of its ends to the three point linkage of a tractor in either a vertical or horizontal orientation, a collar slidable longitudinally of the mast a double-acting hydraulic ram connected between a position at or adjacent said first of the ends of the mast and the slidable collar, an abutment member on the collar, and a knife member securable at or adjacent a second of the ends of the mast, the arrangement being such that with the mast in a vertical orientation the abutment member can be used for pressing stakes into the ground and with the mast in a horizontal orientation the abutment member can press logs or stakes towards the knife member to split the logs or stakes longitudinally. Preferably an unstable relief valve is provided in a hydraulic power connection to the double-acting ram to impart a vibratory hammer action to the abutment member.

2 Claims, 4 Drawing Figures

HYDRAULICALLY POWERED ATTACHMENT FOR A TRACTOR

The invention relates to a hydraulically powered attachment for a tractor.

It is an object of the invention to provide a versatile attachment for a tractor whereby an operator can effect stake driving, for example for fencing, and can also split logs longitudinally, for example to form the stakes to be driven.

The invention provides a hydraulically powered attachment for a tractor comprising a rigid elongate mast, means whereby the mast can be mounted at a first of its ends to the three point linkage of a tractor alternatively in a vertical and a horizontal orientation, a collar slidable longitudinally of the mast, a double-acting hydraulic ram connected between a position at said first of the ends of the mast and the slidable collar, an abutment member on the collar and a knife member securable at a second of the ends of the mast, the arrangement being such that with the mast in a vertical orientation and abutment member can be used for pressing stakes into the ground and with the mast in a horizontal orientation the abutment member can press pieces of timber towards the knife member to split the pieces of timber longitudinally for example to form stakes.

Advantageously an unstable relief valve is provided in a hydraulic power connection to or from the double-acting ram to impart a vibratory hammer action to the abutment member.

Preferably the mast can be mounted on the three point linkage of a tractor such that the abutment member and knife member project upwardly and/or downwardly from the mast so that the attachment can be used for splitting logs lying on the ground beneath the mast or stakes held in a position above the mast.

The attachment may include a set of forks on a frame having connection means for connection to the collar whereby, with the mast in a vertical orientation, the attachment can serve as a fork-lift.

Preferably a plurality of optionally useable connection positions are provided on the mast for the connection thereto of the double-acting ram.

The means whereby the mast is to be connected to the three point linkage of a tractor may include a frame for use with the mast in a horizontal orientation and detachable from the mast when the mast is to be connected in a vertical orientation.

The invention is diagrammatically illustrated by way of example in the accompanying drawings, in which.

Figure 1:
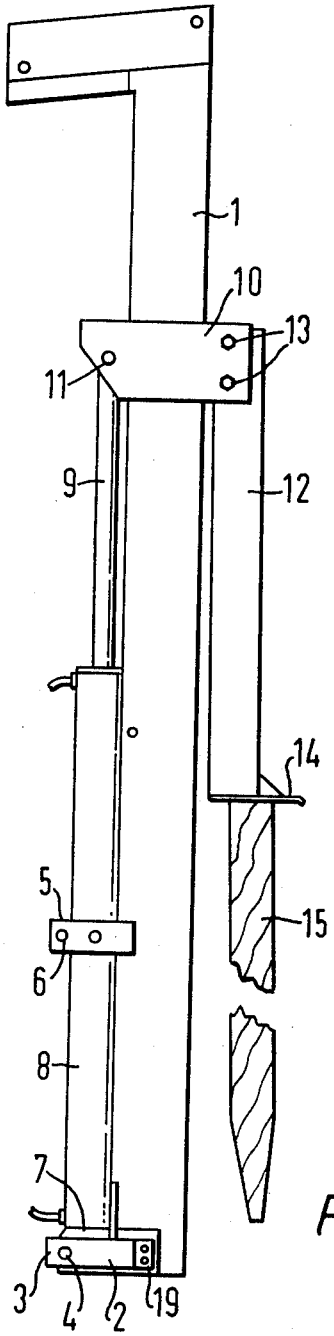
FIG. 1 is an elevation of a hydraulically powered attachment for a tractor shown in a vertical orientation.
Figure 2:
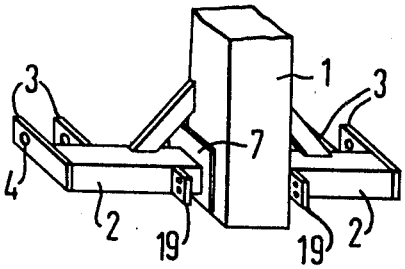
FIG. 2 is a perspective view of the lower end of the attachment of FIG. 1.

Referring to the drawings, a hydraulically powered attachment for a tractor comprises a mast 1 having at its lower end laterally projecting cross-pieces 2 with pairs of lugs 3 thereon, the lugs 3 having apertures 4 therein. At a position above the cross-pieces 2, cheek plates 5 are secured to the side faces of the mast 1 and have aligned apertures 6 therein. By means of the apertures 4 and 6 the mast 1 may be mounted in a vertical orientation at the rear of a conventional farm tractor by securing, by means of pivot pins, the pairs of lugs 3 to the bottom two arms of the three point linkage of the tractor and securing the upper link of the three point linkage by a pin passing through the aperture 6 in the cheek plates 5.

Cheek plates 7 at the lower end of the mast 1 mount the lower end of the cylinder of a double-acting ram 8, the piston rod 9 of which is secured to a collar 10 by means of a pivot pin 11, the collar 10 being slidable on the mast 1. In the configuration shown in FIG. 1, an abutment member 12 is secured to the collar 10 by bolts 13 on the opposite side of the mast to that at which the double-acting ram 8, 9 is located, the abutment member 12 having a plate 14 at its lower end.

By locating a stake 15 beneath the plate 14 of the abutment member 12 and supplying hydraulic fluid to an upper connection 16 on the cylinder 8 of the hydraulic ram, the stake can be pushed into the ground. The hydraulic power connection to the connection 16 includes (not shown) an unstable relief valve whereby the connection 16 can be relieved to a hydraulic reservoir such that when pressure is applied to the stake 15 the unstable relief valve causes a vibratory hammer action rather than a steady pressure, such hammer action being very effective to press the stake into the ground. If the ground is very hard or stoney, a pointed hardened steel stake may first be connected to the abutment member 12 and driven into the ground, the steel stake having a plate at its upper end which can be bolted to the plate 14 of the abutment member 12 so that the steel stake can be withdrawn and a wooden stake inserted in its place.

Figure 3:
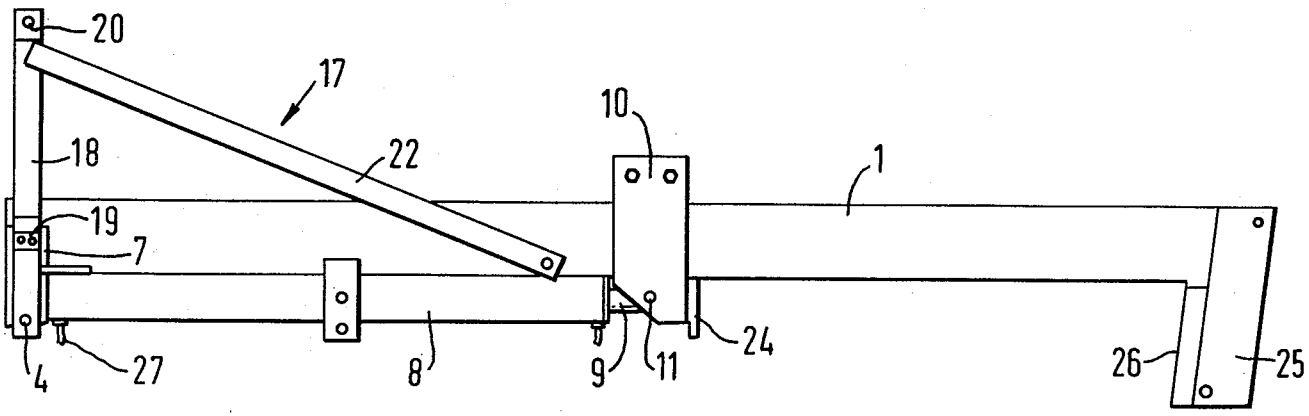
FIG. 3 is an elevation of the hydraulically powered attachment of FIG. 1 in a horizontal orientation.
Figure 4:
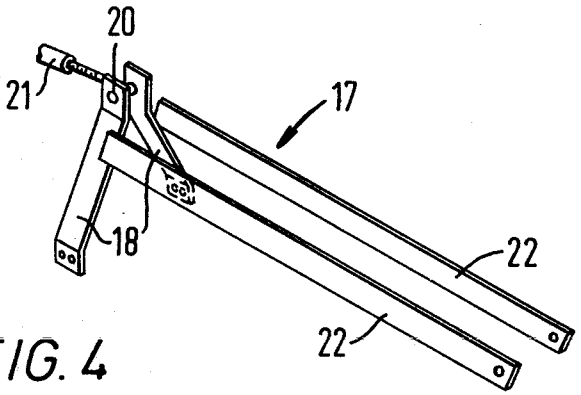
FIG. 4 is a perspective view of an additional frame shown in FIG. 3.

In the configuration shown in FIG. 3, the mast 1 extends in a horizontal configuration and is connected to the lower pair of arms of the three point linkage of the tractor, in similar manner to that of the configuration of FIG. 1 but inverted, by pins passing through the apertures 4 in the pairs of lugs 3. The top link of the three point linkage of the tractor is however connected to a framework 17, as shown in FIG. 4, which has a pair of arms 18 which are connected to lugs 19 on the cross-pieces 2 of the mast, and at their upper ends are connected together by a pin 20 which is also secured to the top link 21 of the tractor. Each arm 18 has a projecting arm 22 thereon coupled by pins to apertures 23 (FIG. 1) in the mast 1. An abutment plate 24 is provided on the collar 10 and a projection 25 is provided at the upper end of the mast 1, the projection 25 having a knife edge 26.

By locating the mast 1 over a log, not shown, with the longitudinal extent of the log extending parallel to the mast 1 and with the abutment plate 24 located at one end of the log and the knife 26 at the other, the log can be split by supplying hydraulic pressure fluid to a connection 27 of the cylinder 8 of the hydraulic ram to cause the abutment plate 24 to move towards the knife edge 26.

If it is desired to split wood to form stakes, the attachment shown in FIG. 3 can be inverted from the position of FIG. 3 and re-attached to the tractor, lugs 19 being provided both on the front and rear faces of the side pieces 2 of the mast 1 so that an operator can rest the pieces of wood to be split into stakes on the upper face of the mast rather than having to support them beneath the mast as he would have to if the configuration of FIG. 3 was used. Alternatively the projection 25 could project both above and below the mast 1 and an abutment plate corresponding to the abutment plate 24 could be provided above the mast so that inversion of the mast from the position of FIG. 3 to enable the operator to work on the top face of the mast would not be necessary.

With the mast in the orientation of FIG. 1, the abutment member 12 can be removed and replaced by a vertical member having at its lower end a cradle including a set of rearwardly projecting forks whereby the attachment can also serve as a fork-lift, the cradle being movable up and down the mast by the ram 8, 9.

The proportions of the length of the mast 1 and the length of the ram 8, 9 can obviously be varied widely and the mast 1 could extend below the cross-pieces 2 if desired to give greater length. Futher sets of cheek plates 7 can be provided at positions along the mast so that the point of connection of the cylinder 8 of the hydraulic ram to the mast can be varied to suit particular requirements.

What is claimed is:

1. A hydraulically powered attachment for a tractor comprising a rigid elongate mast, apertured lugs on said mast whereby said mast can be mounted at a first of its ends to the three point linkage of a tractor alternatively in a vertical and a horizontal orientation; a collar slidable longitudinally of said mast; a double-acting hudraulic ram connected between a position at said first of the ends of said mast and said slidable collar; an abutment member on said collar; and a knife member securable at a second of the ends of said mast, the arrangement being such that with said mast in a vertical orientation said abutment member can be used for pressing stakes into the ground and with said mast in a horizontal orientation, said abutment member can press pieces of timber towards said knife member to split said pieces of timber longitudinally.

2. A hydraulically powered attachment for a tractor as claimed in claim 1, comprising further apertured lugs on said mast, a framework connected to said further apertured lugs and to the three point linkage of a tractor to mount said mast for use in a horizontal orientation, said framework being detachable from said mast when said mast is to be used in a vertical orientation.

* * * * *